US005211572A

United States Patent [19]

Comstock et al.

[11] Patent Number: 5,211,572

[45] Date of Patent: May 18, 1993

[54] SECURITY LOCKING KEY MECHANISM FOR ELECTRICAL CONNECTORS

[75] Inventors: Gary M. Comstock, LaGrange; John S. Luthy, Naperville, both of Ill.; Stephen H. McCombs, Louisville, Ky.

[73] Assignee: Molex Incorporated, Lisle, Ill.

[21] Appl. No.: 902,612

[22] Filed: Jun. 23, 1992

[51] Int. Cl.[5] ..... H01R 13/627

[52] U.S. Cl. ..... 439/352; 439/372; 439/451

[58] Field of Search ..... 439/345, 350, 352, 357, 439/372, 304, 369, 371, 451

[56] References Cited

U.S. PATENT DOCUMENTS

| | | | |
|---|---|---|---|
| 4,370,013 | 1/1925 | Niitsu et al. . | |
| 4,746,306 | 5/1988 | Yurtin et al. | 439/357 |
| 4,773,874 | 9/1988 | Kopeski, Jr. | 439/369 |
| 4,906,204 | 3/1990 | Metzger | 439/352 |
| 4,946,404 | 8/1990 | Takenouchi et al. | 439/352 |
| 4,950,179 | 8/1990 | Takenouchi et al. | 439/352 |
| 4,984,998 | 1/1991 | Ducan et al. | 439/352 |
| 5,090,916 | 2/1992 | Magnier | 439/352 |
| 5,104,335 | 4/1992 | Conley et al. | 439/369 |

*Primary Examiner*—Paula A. Bradley
*Assistant Examiner*—Khiem Nguyen
*Attorney, Agent, or Firm*—Stephen Z. Weiss

[57] ABSTRACT

A security locking system is disclosed for use with an electrical connector which includes a latch device for latching the connector to a complementary mating electrical connector. The latch device has a depressible portion to effect unlatching of the device. The depressible portion has a vacant space therebeneath. A locking key is insertable in a given direction into the vacant space beneath the depressible portion to prevent unlatching of the latch device. Retaining shoulders are provided on the locking key, engageable with the connector, to prevent removal of the key opposite the given direction. The locking key is sufficiently flexible in a direction transverse to the given direction to effect disengagement of the retaining shoulders in response to bending the key transverse to the given direction. A stop of a given height is provided on the connector to prevent bending the locking key unless the key is lifted above the height of the stop. A tether device is provided for tethering the locking key to an electrical cable terminated to the electrical connector to prevent misplacement of the locking key.

8 Claims, 2 Drawing Sheets

SECURITY LOCKING KEY MECHANISM FOR ELECTRICAL CONNECTORS

FIELD OF THE INVENTION

This invention generally relates to the art of electrical connectors and, particularly, to a security locking system which prevents the disengagement of a pair of mating connectors.

BACKGROUND OF THE INVENTION

Typical electrical connector assemblies include a pair of connector housings of dielectric material, such as male and female connector housings, which mount complementarily interengaging terminals so that the terminals complete electrical circuits when the housings are fully mated in some applications, the male and female connector housings are relatively easy to separate or unmate to disconnect the electrical circuit. In other applications, it may be desirable to prevent separation or unmating of the connectors if at all possible.

For instance, in automotive applications, it may be desirable to unmate a pair of electrical connectors for purposes of servicing a vehicle, but unintentional separation of the connectors could lead to serious consequences. Similarly, in various appliance applications, such as refrigerators or food freezers, again it may be desirable to separate or unmate the connectors for purposes of servicing the appliances, but unintentional separation of the connectors could lead to loss or spoilage of the appliance contents.

Consequently, various approaches have been made to design mating electrical connectors with security locking systems which prevent separation of the connector housings of a male and female connector assembly.

For example, many electrical connector assemblies employ latching devices between the housings of the male and female connectors. The latching devices often are provided in the form of flexible latch arms on one connector housing for snapping into engagement with latch bosses or detents on the mating connector housing. It has been found that such flexible latch arms, themselves, can be unintentionally separated through handling or by other means. Consequently, security locking keys have been employed in conjunction with such latching devices to prevent the latching devices, themselves, from becoming disengaged.

Heretofore, one of the problems with security locking key systems has been that the locking keys are difficult, if not impossible, to remove should it be desirable to separate the connectors, without destroying the keys or associated portions of the connector housings. It would be desirable to provide a simple security locking key system wherein the locking keys can be easily removed to separate the connectors if desired.

Another problem with security locking key systems in electrical connector applications is that the keys often are misplaced or simply difficult to handle while manipulating the connector housings of the connector assembly.

This invention is directed to providing a simple, yet effective security locking key system for electrical connectors, wherein a locking key can be readily removed without destroying the key or associated portions of the electrical connectors, and also to providing a security locking key system wherein the locking key is tethered to the electrical connector assembly so that it cannot be misplaced and is readily available for use.

SUMMARY OF THE INVENTION

An object, therefore, of the invention is to provide a new and improved security locking key system for a pair of latchable electrical connectors.

In the exemplary embodiment of the invention, generally an electrical connector includes latch means for latching the connector to a complementary mating electrical connector. The latch means include a depressible portion effective to unlatch the latch means. The depressible portion has a vacant space therebeneath. A locking key is insertable in a given direction into the vacant space beneath the depressible portion of the latch means to prevent unlatching thereof.

The invention contemplates the provision of complementary interengaging retaining means between the connector and the locking key to prevent removal of the key opposite the given or insertion direction. The locking key is sufficiently flexible in a direction transverse to the insertion direction to effect disengagement of the retaining means in response to bending the key transverse to its insertion direction. As disclosed herein, the locking key is in the form of a tongue having an interior slot providing sufficient flexibility for bending the tongue. The tongue has an insertion end, and the retaining means is formed by shoulder means projecting transversely outwardly of the tongue. The interior slot extends in a direction from the insertion end of the tongue past the shoulder means a sufficient distance for the tongue to collapse inwardly in response to bending the tongue to disengage the shoulder means.

The invention also contemplates the provision of a feature which includes stop means on the connector, the stop means being of a given height. The stop means is engageable by the locking key in a transverse direction to prevent bending the key unless the key is lifted above the height of the stop means. Therefore, the security locking system of the invention includes (1) latching means between the mating electrical connectors, (2) a locking key to prevent unlatching of the latch means, and (3) novel means for preventing unintentional removal of the locking key itself.

Another feature of the invention is the provision of tether means having an elongated portion, with the locking key at one end thereof. A loop is provided at the other end of the elongated portion and through which an electrical cable, terminated to the electrical connector, is insertable. Therefore, the locking key is readily available during manipulation of the electrical connector and is incapable of being misplaced or lost.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
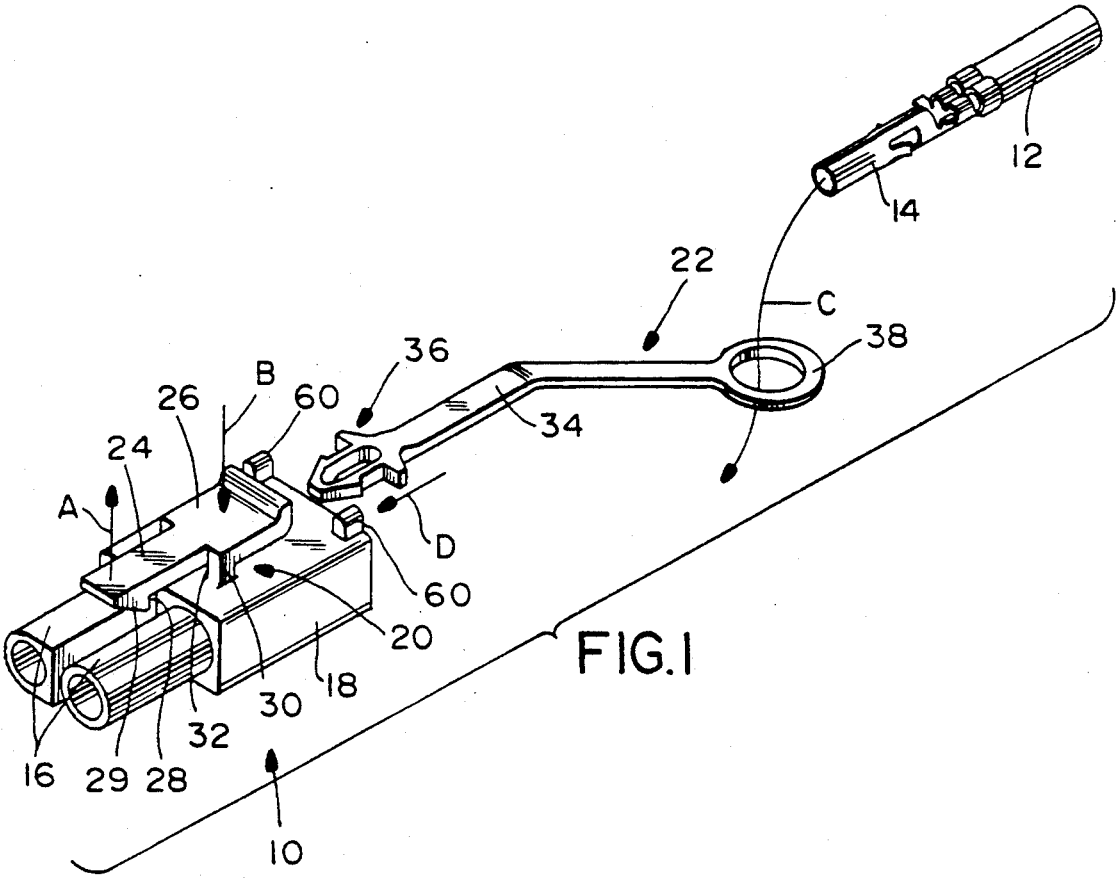
FIG. 1 is a perspective view of the security locking key system of the invention in conjunction with a latchable electrical connector housing and an electrical cable terminated within the housing, in unassembled condition.

Referring to the drawings in greater detail, and first to FIG. 1, the invention is embodied in a security locking key system for use with an electrical connector, generally designated 10, which is latchable to a complementary mating electrical connector (not shown). An electrical cable 12 is terminated to a female or socket terminal 14 which, in turn, is inserted into one of a pair of plug portions 16 projecting forwardly from a dielectric housing 18 of connector 10. Therefore, connector 10 is a male or plug connector for mating with a complementary female or receptacle connector, with plug portions 16 insertable into respective receptacle means of the female connector. The female connector has an appropriate male or pin terminal which is inserted into female or socket terminal 14. Connector housing 18 is shown to have two plug portions 16 for receiving two socket terminals 14 terminated to respective electrical cables 12, although only one socket terminal 14 and cable 12 are shown in the drawings. To this point, the description of electrical connector 10, socket terminal 14 and electrical cable 12 is generally conventional in the electrical connector art.

The invention contemplates a security locking system which includes latch means, generally designated 20, on connector housing 18, and a security locking key, generally designated 22. Latch means 20 is molded integrally with connector housing 18 and includes a forwardly projecting latch arm portion 24 and a rearwardly projecting depressible portion 26. The latch arm portion 24 has a latch hook 28 with a cam surface 29 on the underside thereof. When plug connector 10 is mated with a complementary receptacle connector, cam surface 29 will engage a latch boss on the mating connector to bias latch arm portion 24 upwardly in the direction of arrow "A", and hook 28 will snap behind the latch boss of the complementary connector. When it is desirable to unlatch the connectors, an operator pushes down on depressible portion 26 in the direction of arrow "B". This causes latch arm portion 24 to pivot upwardly about a pair of fulcrum legs or bosses 30 in the direction of arrow "A", and the mating connectors can be unlatched. Lastly, fulcrum legs 30 define a vacant space 32 beneath latch arm portion 24 and depressible portion 26.

Locking key 22 includes an elongated tether portion 34, a locking key portion or tongue 36 at one end of the elongated portion, and a loop 38 at the opposite end of the elongated portion. Before proceeding with a detailed description of the construction and operation of locking key portion or tongue 36 of locking key 22, reference is made to FIG. 2 in conjunction with FIG. 1 in order to describe the general operation of the security locking key system of the invention.

Figure 2:
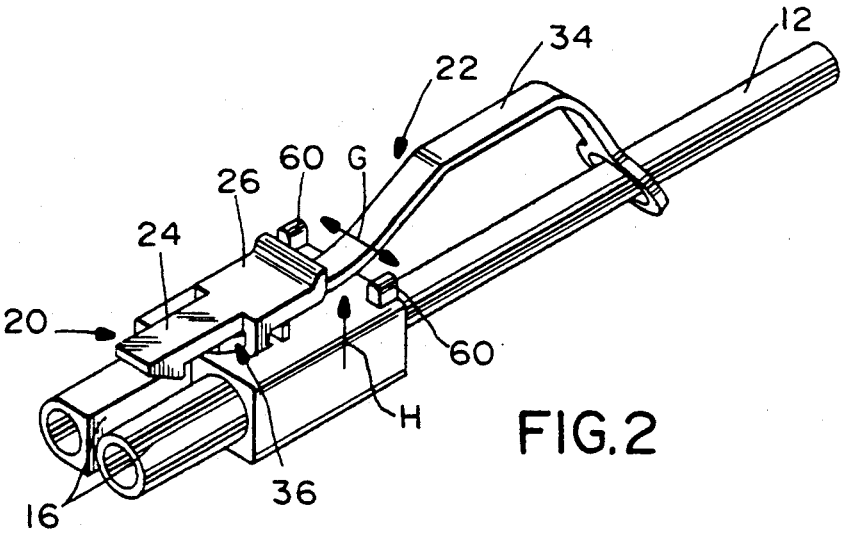
FIG. 2 is a perspective view similar to that of FIG. 1, with the security locking key in assembled condition with the electrical connector and cable.

More particularly, one of the "sub assemblies" of socket terminal 14 and electrical cable 12 is inserted through loop portion 38 in the direction of arrow "C" (FIG. 1). Locking key 22, thereby, is permanently tethered to the electrical cable and cannot be misplaced or lost. Locking key portion or tongue 36 then is inserted into the vacant open space 32 beneath depressible portion 26 and latch arm portion 24 of latch means 20, in the direction of arrow "D" as seen in FIG. 2. The locking key portion thereby occupies the space beneath the depressible portion and the depressible portion cannot be pushed downwardly to release latch arm portion 24 from latching engagement with the complementary mating connector. It can be seen in the locked condition of FIG. 2, that locking key 22 is fairly flexible as indicated by the flexure of elongated portion 34. The entire locking key, preferably, is unitarily molded of dielectric material such as plastic or the like.

Figure 3:
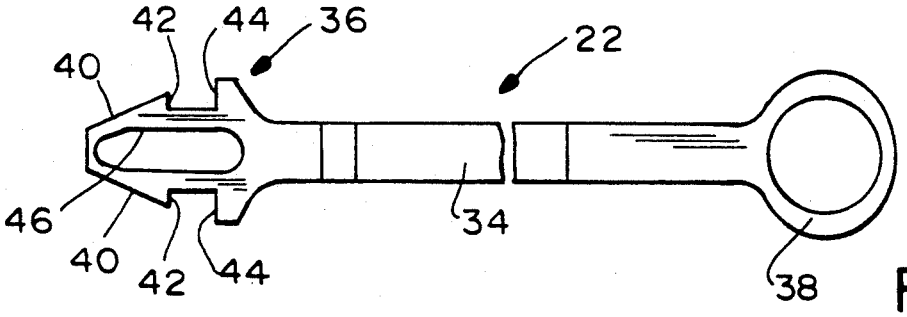
FIG. 3 is a broken-away top plan view of the security locking key of the invention.
Figure 4:
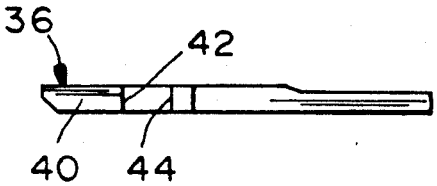
FIG. 4 is a fragmented side elevational view of the insertion end of the locking key.

Referring to FIGS. 3 and 4 in conjunction with FIGS. 1 and 2, locking key portion or tongue 36 of security locking key 22 is "arrow" shaped at its forward end to define a pair of rearwardly diverging cam surfaces 40. These cam surfaces guide the tongue between the fulcrum legs 30 projecting upwardly from connector housing 18, i.e. into the vacant open space beneath the depressible portion 26 of latch means 20. Tongue 36 includes retaining means in the form of a pair of outwardly projecting retaining shoulders 42 which will snap behind fulcrum legs 30 when the tongue is fully inserted into its locking position. In other words, the shoulders project transversely of the insertion direction "D" (FIG. 1) of the locking key. A pair of outwardly projecting, forwardly facing stop shoulders 44 will engage fulcrum legs 30 to define the fully inserted and locked position of locking tongue 36.

Generally, locking key portion or tongue 36 of security locking key 22 is sufficiently flexible in a direction transverse to the insertion direction "D" to effect disengagement of shoulders 42 from fulcrum legs 30 in response to bending the key transverse to the insertion direction. This flexibility is provided by an elongated interior slot 46 extending in a direction from the insertion end of tongue 36 past retaining shoulders 42 a sufficient distance whereby the tongue will collapse upon bending thereof.

Figure 5:
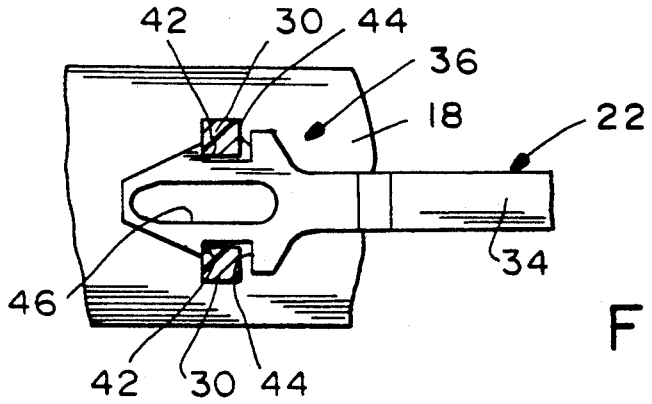
FIG. 5 is a fragmented plan view of the locking key in locked condition relative to the electrical connector.
Figure 6:
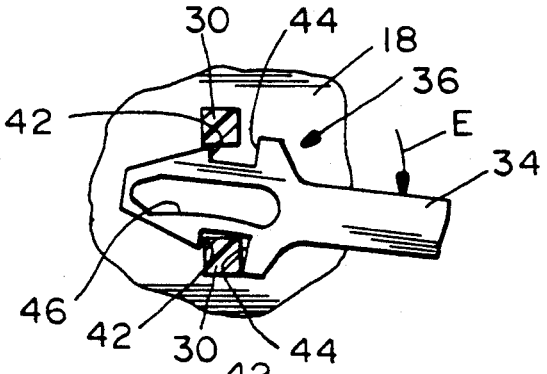
FIG. 6 is a view similar to that of FIG. 5, with the locking key bent to allow removal thereof.
Figure 7:
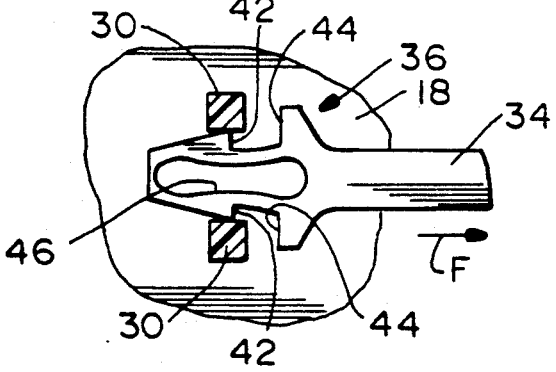
FIG. 7 is a view similar to that of FIGS. 5 and 6, with the locking key collapsed and about to be removed.

Reference now is made to FIGS. 5-7 to illustrate the flexibility of locking key portion or tongue 36 and the action effected to remove the tongue from locking condition with respect to electrical connector 10. Specifically, FIG. 5 shows locking key or tongue 36 in fully locked position, with retaining shoulders 42 snapped behind fulcrum legs 30 projecting upwardly from connector housing 18. As stated above, stop shoulders 44 define the fully inserted position of the tongue and prevent overinsertion thereof.

Referring to FIG. 6, when it is desirable to remove locking key or tongue 36 from its locked position of FIG. 5, the tongue is twisted or bent transversely of its insertion direction, as indicated by arrow "E". Of course, the tongue alternatively could be bent in the opposite transverse direction. When so bent, elongated interior slot 46 allows the tongue to begin to collapse, as shown, whereby the retaining shoulder 42 on the side of the tongue opposite the bending direction releases from behind its respective fulcrum leg 30. Further bending in the direction of arrow "E" effects further collapsing of the tongue until the other retaining shoulder 42 (i.e. the retaining shoulder in the direction of the bend) slides past its respective fulcrum leg 30 to the position shown in FIG. 7. The collapsing of the tongue can be seen by the collapsed configuration of elongated slot 46. The tongue now can be removed in the direction of arrow "F" (FIG. 7).

A further feature of the invention is shown in FIGS. 1 and 2, wherein a pair of stop bosses 60 are molded integrally with and project upwardly from connector housing 18. These stop bosses are of a height whereby, in the event that the locking key or tongue is bent transversely in the direction of double-headed arrow "G" (FIG. 2), elongated tether portion 34 will abut against either one or the other of the stop bosses. Therefore, inadvertent bending of the security locking key transverse to its insertion direction will not automatically release the locked condition thereof. An operator intentionally removes the key by effecting both lifting and bending of the security locking key. Specifically, an operator lifts on tether portion 34 in the direction of arrow "H" (FIG. 2), above the height of stop bosses 60, and then proceeds to bend the locking key as described above in relation to FIGS. 6 and 7 in order to unlock the key. Consequently, an additional measure of safety is afforded by requiring the operator to both lift and bend the key in order to effect its removal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes latch means for latching the connector to a complementary mating electrical connector, the latch means having a depressible portion effective to unlatch the latch means, the depressible portion having a vacant space therebeneath, and a locking key insertable in a given direction into the vacant space beneath the depressible portion to prevent unlatching of the latch means, wherein the improvement comprises complementary interengaging retaining means between the connector and the locking key to prevent removal of the key opposite said given direction, the locking key is sufficiently flexible in a direction transverse to said given direction to effect disengagement of the retaining means in response to bending the key transverse to said given direction, and stop means of a given height on the connector engageable by the locking key in a transverse direction to prevent bending the key unless the key is lifted above the height of the stop means.

2. In an electrical connector as set forth in claim 1, wherein said locking key includes a tongue having an interior slot providing sufficient flexibility for bending the tongue.

3. In an electrical connector as set forth in claim 2, wherein said tongue has an insertion end, said retaining means include shoulder means projecting transversely outwardly of the tongue spaced from said insertion end, and said interior slot extends in a direction from said insertion end past the shoulder means a sufficient distance for the tongue to collapse inwardly in response to bending the tongue to disengage the shoulder means.

4. In an electrical connector as set forth in claim 1, wherein said locking key includes tether means for tethering the key to an electrical cable terminated to the electrical connector.

5. In an electrical connector as set forth in claim 4, wherein said tether means include an elongated portion with a locking key portion at one end thereof, and including a loop at the other end of the elongated portion through which the electrical cable is insertable.

6. In an electrical connector which includes latch means for latching the connector to a complementary mating electrical connector, the electrical connector being terminated to an electrical cable, and including a security locking key operatively associated with the latch means to prevent unlatching thereof, wherein the improvement comprises tether means including an elongated portion with said locking key at one end thereof, and a loop at the other end of the elongated portion through which the entire cross-section of the electrical cable is insertable operatively associated between the locking key and the electrical cable for tethering the key to the cable to prevent misplacement thereof.

7. In an electrical connector which includes a dielectric housing and latch means for latching the connector to a complementary mating electrical connector, and a security locking key operatively associated with the latch means to prevent unlatching thereof, wherein the improvement comprises complimentarily interengaging surface means between the locking key and the connector housing for effecting removal of the locking key in response to movement of the locking key in a first direction and then moving the locking key in a second direction generally perpendicular to said first direction and stop means on the connector housing of a given height to prevent movement of the locking key in said second direction, whereby the locking key is moved in said first direction to clear the stop means and to allow movement of the locking key in said second direction.

8. In an electrical connector as set forth in claim 7, including retaining means operatively associated between the locking key and the connector housing for retaining the locking key in a locked position, said retaining means being releasable upon movement of the locking key in said second direction.

* * * * *